United States Patent [19]

Smith

[11] 4,317,859

[45] Mar. 2, 1982

[54] SOIL-RESISTANT YARNS

[75] Inventor: Andrew I. Smith, Pensacola, Fla.

[73] Assignee: Monsanto Company, St. Louis, Mo.

[21] Appl. No.: 167,981

[22] Filed: Jul. 14, 1980

Related U.S. Application Data

[63] Continuation of Ser. No. 24,349, Mar. 27, 1979, abandoned.

[51] Int. Cl.[3] ..... B32B 9/00; B32B 15/00; D02G 3/00

[52] U.S. Cl. ..... 428/389; 57/250; 57/258; 428/375; 428/392; 428/393; 428/394; 428/395

[58] Field of Search ..... 428/375, 378, 392, 394, 428/395, 421, 422, 389, 384, 379; 57/250, 251, 258

[56] References Cited

U.S. PATENT DOCUMENTS

| | | | |
|---|---|---|---|
| 2,734,835 | 2/1956 | Florio et al. | 428/87 |
| 3,031,335 | 4/1962 | Segal et al. | |
| 3,547,861 | 12/1970 | Anello et al. | 428/392 |
| 3,592,684 | 7/1971 | Smith | 428/272 X |
| 3,620,823 | 11/1971 | Smith | 427/390 R |
| 3,671,292 | 6/1972 | Hirshfeld et al. | 427/390 E |
| 3,816,229 | 6/1974 | Bierbrauber . | |
| 3,828,087 | 8/1974 | Pittman | 528/35 |

*Primary Examiner*—Lorraine T. Kendell
*Attorney, Agent, or Firm*—John W. Whisler

[57] ABSTRACT

Soil-resistant carpet yarns are provided by providing yarns coated with, for example, a fluorochemical and zirconium oxide. Such yarns when used in the manufacture of carpets retain their soil-resistant properties during the carpet dyeing and finishing operation; the zirconium oxide in some way promotes the retention of the fluorochemical on the yarn.

5 Claims, No Drawings

SOIL-RESISTANT YARNS

This is a continuation of application Ser. No. 024,349 filed Mar. 27, 1979, now abandoned.

BACKGROUND OF THE INVENTION

A. Field of the Invention

This invention relates to novel soil-resistant yarns, to a process for producing such yarns and to fabrics made therefrom. The term "yarn" as used herein includes staple yarn and continuous filament yarn.

B. Description of the Prior Art

The post treatment of textile fabrics, such as finished carpets, with sprays containing soil retardants such as fluorochemicals to impart soil resistance thereto and, in particular, to impart oil and water repellency thereto, is widely practiced both by housewives and fabric manufacturers. Fluorochemicals described as being useful in the post treatment of textile fabrics include those described in the following U.S. Pat. Nos. 4,043,964; 4,043,923; 3,987,227; 3,916,053; 3,896,035; 3,816,229; 4,013,627; 3,872,058; 3,849,521; 3,316,167; 3,811,933; 3,708,537; 3,651,069; 3,645,990; 3,592,686; 3,574,791; 3,547,894; 3,544,663; 3,503,915; 3,491,169; 3,484,281; 3,462,296; 3,398;182; 3,282,905; 3,277,039; 3,256,231; 3,256,230; 3,068,197; 2,803,615; and 2,642,416. Also of interest is British Pat. No. 1,504,463. All of the above patents are herewith incorporated by reference. Fluorochemicals which have enjoyed commercial success for use in the post treatment of finished carpets include Scotchgard Brand Stain Repeller, a brand name of Minnesota Mining and Manufacturing Company, and Zepel and Teflon, trademarks of E. I. DuPont de Nemours and Company for fluorocarbon textile finishes.

The fluorochemical post treatment of carpets involves spraying or otherwise applying sufficient fluorochemical composition (i.e. fluorochemical in a suitable liquid medium, such as water or solvent) to the pile facing of a finished carpet to provide a desired wet pickup of fluorochemical and then drying the piling to remove the liquid and leave a coating of fluorochemical thereon. The treatment has several drawbacks. One drawback, particularly in the case of plus cut-pile carpets, is that only the surface of the carpet (exposed tuft ends) is protected, that is, coated with fluorochemical. In other words, the treatment does not penetrate down into the carpet and protect the middle and lower regions of the piling where soil tends to build up. As a result, the treatment protects (i.e. imparts soil resistance to) only a minor portion of the carpet piling. Another drawback is that the fluorochemical tends to be removed during normal use and cleaning of the carpets.

Attempts have been made in the past to coat the yarns prior to tufting with the prior art fluorochemical compositions. However, such attempts have heretofore been unsuccessful because the fluorochemical does not stay on the yarn or at least an effective amount thereof does not stay on the yarn during subsequent carpet processing operations and, in particular, during carpet dyeing.

It is an object of the present invention to provide a novel soil-retardant composition which overcomes the above-mentioned drawbacks of the prior art fluorochemical compositions and which may be effectively applied to the yarn from which textile fabrics, such as carpets, are made.

Other objects and advantages of the invention will become apparent to those skilled in the art from the following detailed description thereof.

SUMMARY OF THE INVENTION

The objects of this invention are accomplished by providing a yarn coated with an effective amount of a soil retardant, such as a fluorochemical, and with a retaining agent, such as zirconium oxide, in an amount sufficient to promote the retention of the soil retardant on the yarn.

The term "soil retardant" as used herein means any material which when present as a coating on a yarn or fabric reduces the rate at which the yarn or fabric is soiled as determined by the "Laboratory Jar Soil Test" described hereinafter in Example 1.

The term "retaining agent" as used herein means any material which when present in combination with a soil retardant as a coating on a yarn renders the soil retardant more tenaciously attached to the yarn than when the retaining agent is omitted from the coating as determined by said Laboratory Jar Soil Test.

The term "effective amount of soil retardant" as used herein means an amount thereof sufficient to reduce the rate at which a yarn or fabric is soiled as determined by the Laboratory Jar Soil Test.

Preferably, the coating is applied to yarns by treating the yarns with an aqueous finish comprising the soil retardant (e.g. fluorochemical) and retaining agent or a retaining agent precursor. By "retaining agent precursor" is meant a compound (such as a water-soluble metal salt) from which the retaining agent (such as metal oxide) is later formed. Most preferably, the aqueous finish is applied to the yarn as a spin finish. However, if desired, the retaining agent or its precursor may be applied to the yarn prior to or after application of the soil retardant thereto, for example, the retaining agent or its precursor may be applied to the yarn from a spin finish and then the soil retardant may subsequently be applied to carpet piling prepared from the yarn, for example, from the dye bath used to dye the carpet or from a spray composition applied to the finished carpet. When fluorochemical soil retardants are applied from the dye bath to yarn already coated with certain retaining agents or precursors thereof (e.g. metal oxides), it has been found that the retaining agent is more effective when the pH of the dye bath is adjusted to below about 5.0 (e.g. 2.8) with a mineral acid such as phosphoric acid.

The coated yarns of this invention, owing to the presence of the retaining agent, soil at a slower rate and tend to have longer lasting anti-soiling properties than corresponding yarns from which the retaining agent is omitted from the coating (i.e. prior art yarns). Carpet pile fabrics prepared from the coated yarns can be subjected to carpet processing operations, such as dyeing, without substantial loss of soil-resistant properties.

According to a variation in the invention the retaining agent or its precursor is applied to carpet yarn at some point prior to the dyeing of the yarn (e.g. in a spin finish) and then the soil retardant is applied to the yarn, for example, by spraying the finished carpet with a composition comprising the soil retardant. Although this latter procedure does not eliminate post treatment spraying of carpet pilings, the resulting carpets tend to possess longer lasting soil-resistant properties than when the retaining agent coating is omitted from the carpet piling yarn. Also, when the yarn is coated with retaining agent, the same degree of soil retardancy can be obtained with significantly less soil retardant than when the retaining agent coating is omitted.

PREFERRED EMBODIMENTS OF THE INVENTION

Preferred soil retardants for use in practicing the present invention include fluorochemicals of the type described in the above-referenced patents. Particularly preferred fluorochemicals are those containing a fluorinated, preferably saturated, aliphatic radical ($R_f$) which radical contains 3 to 20 carbon atoms, preferably 6 to 12, and the carbon-bonded fluorine content thereof is 40–78 weight percent, preferably 50–77 weight percent. Preferably, $R_f$ is a perfluoroalkyl, $C_nF_{2n+1}$. Such fluorochemicals and their preparation are described in the patent literature such as, for example, in U.S. Pat. Nos. 4,043,964; 4,043,923; 3,987,227; 3,916,053; 3,896,035; and 3,816,229 and are conveniently prepared; for example, by reacting a precursor fluorochemical amine or alcohol with a suitable anhydride or isocyanate, for example, the reaction of N-ethyl perfluorooctanesulfonamidoethanol and 2,4-toylene disocyanate in a mole ratio of 2:1 to provide a bis-urethane polymer containing 15 to 30% by weight fluorine.

Other preferred soil retardants which may be used in practicing the invention include those formed by reacting, for example, polymethacrylate, with the $C_4$ to $C_{12}$ product formed by reacting tetrafluoroethylene with a chain transfer agent such as $HO—CH_2CH_2—Cl$. Normally, while sufficient chain transfer agent is added to provide a desired chain length (e.g., $C_8$), the product also contains $C_4$ to $C_8$ and $C_8$ to $C_{12}$ compounds. Although soil retardants are usually polymeric, it is contemplated that monomeric soil retardants may also be used, for example, perfluorooctanoyl glycine.

Preferred retaining agents for use with the soil retardants in accordance with the present invention are metal oxides, such as zirconium oxide, tin oxide and titanium oxide. Preferably, the metal oxide coating on the yarn is provided by applying an aqueous solution of a water-soluble salt of the metal (retaining agent precursor) to the yarn and then drying the yarn, whereby a metal oxide (retaining agent) coating is obtained on the yarn. Representative water-soluble metal salts (retaining agent precursors) include but are not limited to the acetate, chloride, bromide, oxalate, sulfate and nitrate salts of tin, zirconium and titanium. Tin and zirconium salts are preferred since tin and zirconium oxides in addition to functioning as retaining agents impart dry soil resistance to yarns and fabrics, a property not imparted thereto by fluorochemicals.

The exact structure of the metal oxide retain agent and the mechanism by which it is formed from its precursor are not fully understood. However, it is believed that the metal oxide coating is polymeric in nature and is formed from zirconium acetate by the following mechanism:

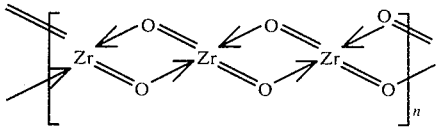

or simply $(ZrO_2)_n$ where one or more of the oxygen atoms may be an $OH^+$ radical. (n is a number greater than 1.) The term "metal oxide" is used herein to include simple metal oxides (e.g. $ZrO_2$) and complex metal oxides (e.g. the zirconium oxide represented by the above structure). For a more detailed explanation of zirconium oxide, their structure and behavior attention is directed to Blumenthol's book entitled "The Chemical Behavior of Zirconium", published by D. Van Nostrand Company, New York (1958).

Preferably, the retaining agent or its precursor is applied to the yarn from an aqueous spin finish. Useful retaining agent precursor-containing spin finishes are described in U.S. Pat. Nos. 3,592,684 and 3,620,823 and these patents are also incorporated herein by reference. The retaining agent precursor, for example, zirconium acetate, may be applied to the yarn from the aqueous finish in an amount sufficient to coat the yarn with 775 to 1550 ppm zirconium oxide (measured as $ZrO_2$), that is, parts by weight of $ZrO_2$ per million parts by weight of fiber. The soil retardant, for example, fluorochemical, may be also applied to the yarn from the aqueous finish in amount sufficient to coat the yarn with 500 to 5,000 ppm of the fluorochemical. While the above-mentioned of soil retardant and retaining agent have been found to produce favorable results, it is contemplated that any desired amount of the compounds may be used in combination with one another.

Preferably the aqueous finish also contains a polyol in addition to the retaining agent (or its precursor) and soil retardant. The polyol not only serves as a lubricating agent to facilitate processing of the yarn, but in certain instances also significantly promotes the retention of the retaining agent (e.g. zirconium oxide) on the yarn. The term "polyol" as used herein means a compound consisting essentially of C, H and O atoms and containing two or more —OH groups. Polyol lubricating finish components for yarns are well-known in the art and are commercially available. Representative such polyols include alkylene glycols, polyalkylene glycols, poly(oxyalkylene) glycols, hydroxy ethers and hydroxy terminated polyethers, alkylene glycol-fatty acid condensation, and alcohols. Particularly useful polyols are those having terminal hydroxy, such as, polyethylene glycols having molecular weights (M.W.) between 200 and 2000 and which are liquid at below about 60° C.

It is believed that, when the polyol and retaining agent or its precursor (e.g. zirconium acetate) are applied to a yarn from a finish (e.g. spin finish), the polyol in some way forms a complex with the retaining agent or its precursor (e.g. zirconium acetate) on the yarn surface. Later, when the yarn is dried and processed, substantially all of the polyol is removed from the yarn leaving only the retaining agent (e.g. zirconium oxide).

Normally, aqueous finish when applied to carpet yarn will also contain a tube tension lubricant for tufting such as polyethylene glycol monooleate having a M.W. of 600. The aqueous finish may also contain a viscosity reducer for the lubricating agent and/or other additives, such as antistats, as desired. In general, water-insoluble components or lipophylic dispersed or suspended components in the finish tend to reduce or negate the effect of the soil retardants and, therefore, such components are preferably omitted from aqueous finishes used in practicing the present invention.

The yarns of this invention may be composed of natural or synthetic fibers, for example, fibers of nylon (e.g. nylon 66 or nylon 6), polyester (e.g. PET), polyolefin, acrylic, modacrylic, wool, cotton, and mixtures thereof.

The following examples are given to further illustrate the invention. In the examples % is percent by weight unless otherwise specified.

EXAMPLE 1

A commercial nylon 66 as-spun carpet yarn having 68 filaments of trilobal cross-section with a modification ratio (MR) of 1.67 and a denier of about 3850 (4278 dtex) was prepared. During the spinning of the yarn a spin finish was applied thereto composed of 28% of component A and 72% of component B. Component A consisted of 18% of a 3/3/2 mixture of polyethylene glycol M.W. 1000, a viscosity reducer therefor, and polyethylene glycol M.W. 600 monooleate. Component B consisted of deionized water. The amount of component A applied to the yarn was about 1.2%. Two ends of the as-spun yarn were combined and draw textured using a conventional gear-type texturing head and a draw pin temperature of about 165° C. The ends were combined on the draw pin before texturing. The draw ratio was adjusted to provide a yarn having a denier of 2460 (2733 dtex) and a bulk ranging between 29.9 and 31.2%. The yarn was tufted into a white Typar® spunbonded polyester fabric backing (primary backing) to give a carpet sample having 22.6 ounces of greige piling per square yard of carpet (0.767 $Kg/m^2$), $\frac{1}{4}$ inch (6.35 mm) pile height using a Singer $\frac{1}{8}$-inch (3.18 mm) gauge tufting machine. (Typar is a trademark of E. I. DuPont de Nemours and Company for fabric backing.)

The carpet was blank dyed in a stainless steel beaker at the boil for 60 minutes with a 40:1 liquor (1.0% of a nonionic surface-active agent, 0.25% sodium hexametaphosphate, 1.0% trisodium phosphate and 97.75% deionized water) to goods (carpet) ratio. The time to reach the boiling point of the liquor (dye bath) was about 20 minutes. The sample was stirred occasionally during boiling, rinsed 3 times with deionized water and dried in the laboratory atmosphere. The pH of the dye bath was 10.6.

The blank dyed carpet was then tested for soil resistance using the laboratory jar soiling test.

In carrying out this test a blank dyed carpet soiling sample (1) and 0.7 grams of 5% oily soil were placed in a one-gallon wide mouth jar containing three internal baffles to insure adequate mixing and a total of 8 No. 2, 3, 4 (mixed) neoprene stoppers for good agitation. The sample was soiled by rotating the jar at the rate of 54 r.p.m. for a given number of soiling intervals at ambient conditions (i.e. room temperature and 65% relative humidity). The sample consisted of two back-to-back carpet strips each measuring $2\times3\frac{1}{4}$ inches (5.08 cm$\times$8.26 cm). In this instance, where a secondary backing had not been applied to the carpet from which the two carpet strips were cut, the primary backing of each strip was taped (using two-face tape) to one side of a $2\times3\frac{1}{4}$ inch (5.08 cm$\times$8.26 cm) piece of cardboard and the primary backing of the other strip was taped in the same manner to the other side of the cardboard. (In instances where a secondary backing is applied to the carpet, the two strips are attached back-to-back with two-face tape.) The 5% oily soil consisted of 0.2% furnace black, 1.4% animal charcoal, 1% to 5% mineral oil (e.g. 5% oil soil consists of 5% mineral oil), and the remainder of the soil (i.e. 93.4 to 97.4%) is dried peat moss sifted to 35 mesh. After each soiling interval of which there were six, both sides of the sample were cleaned with a Sears Roebuck #208.61220 hand vacuum cleaner through a half-inch diameter adaptor on the end of the cleaning hose. The sample was cleaned three times, each cleaning being performed with 7–8 overlapping strokes of the cleaning nozzle both against and with the tuft direction each time. The third cleaning was made with an almost clean (only used 1–3 times and emptied) or new dust bag in the cleaner to insure maximum cleaner efficiency. The 1st soiling interval was 1 minute, the 2nd was 4 minutes, the 3rd was 10 minutes, the 4th was 30 minutes, the 5th was 90 minutes, and the 6th was 270 minutes. After each soiling interval, new soil was charged to the jar (once used soil was discarded). The % of original yarn brightness (Yo) retained by the sample after each soiling interval and cleaning was determined by the formula $Y/Yo\times100$, where Y is the brightness of the soiled sample after cleaning. A soiling curve for the sample was then prepared by plotting $Y/Yo\times100$ values against the log of the corresponding soiling time (i.e. soiling interval) on semi-logarithmic paper. Yo and Y values were measured with a model 610 Photovolt Reflectance Meter fitted with a green tristimulus filter. To determine each Y and Yo value four readings were made (2 readings on each face of the sample) and averaged. By selecting the soiling intervals as specified above (i.e. 1, 4, 10, 30, 90 and 270 minutes) the space between each time on the semi-logarithmic paper is the same. From the curve the soiling times required for the sample to soil to 85% ($t_{85}$) and 80% ($t_{80}$) of its original brightness were determined and found to be 2.0 minutes and 3.5 minutes, respectively.

Substantially the same results are obtained when the blank dyeing is carried out using an acid dyeing procedure (1.0% of Alkanol ND, a trademark of E. I. DuPont deNemours and Company for a surface-active agent, 0.25% sodium hexametaphosphate and 2% ammonium sulfate) at a pH of about 7.0 at the start and about 5.5–6.0 after 1 hour at the boil.

EXAMPLE 2

In this example a blank dyed carpet soiling sample was prepared and tested as described in Example 1 except that the spin finish contained zirconium (added as zirconium acetate) as an additional component in an amount sufficient to coat the yarn with 1160 ppm of zirconium oxide measured as $ZrO_2$. A curve was prepared on semi-logarithmic paper and the $t_{85}$ and $t_{80}$ values were determined as described in Example 1. In this instance $t_{85}$ was 8 and $t_{80}$ was 12.

EXAMPLE 3

In this example a blank dyed carpet soiling sample was prepared and tested as described in Example 2 except that the spin finish contained a fluorochemical-containing aqueous emulsion (F-I) as an additional component in an amount sufficient to coat the yarn with 2000 ppm thereof. The aqueous emulsion (F-I) comprised 6.5% methylisobutyl ketone (MIBK), and 45% solids comprising (i) a bis-urethane prepared by the reaction of N-ethyl perfluorooctanesulfonamidoethanol and tolylene disocyanate in a 2:1 mole ratio and (ii) a vinyl polymer. The ratio of (i) to (ii) is about 72:28 and the fluorine content of the emulsion is 17.7%. Thus, a coating of 2000 ppm of the emulsion provides 159.3 ppm F ($0.45\times0.177\times2000$) on the yarn. $t_{80}$ and $t_{85}$ values were determined in the manner described in Example 2 and were found to be $t_{80}=11$ and $t_{85}=17$.

EXAMPLE 4

In this example a blank dyed carpet soiling sample was prepared and tested as described in Example 3 except that the dye bath contained phosphoric acid as an additional component in an amount sufficient to provide 1% thereof on weight of goods (o.w.g.), i.e., carpet sample. The pH of the dye bath was 2.6. In this instance $t_{80}$ was 21 and $t_{85}$ was 37.

EXAMPLE 5

In this example a blank dyed carpet soiling sample was prepared and tested as described in Example 3 except that in this instant instead of the fluorochemical-containing aqueous emulsion the finish contained an equivalent amount of an aqueous dispersion of a polytetrafluoroethylene (F-II) obtained commercially under the name Zepel C-SF® (a trademark of duPont). In this instance $t_{80}$ was 10 and $t_{85}$ was 16.

EXAMPLE 6

In this example a blank dyed carpet soiling sample (6) was prepared and tested in the manner described in Example 5 except that sufficient phosphoric acid was added to the dye bath to provide 1.-% phosphoric acid o.w.g. (pH of dye bath 2.6). In this instance $t_{80}$ was 21 and $t_{85}$ was 37.

SUMMARY OF EXAMPLES 1-6

TABLE 1

| Example | ppm $ZrO_2$ | ppm F-1 | ppm F-II | Dye Bath pH | $t_{85}$ | $t_{80}$ |
|---|---|---|---|---|---|---|
| 1 | 0 | 0 | 0 | 10.6 | 2.0 | 3.5 |
| 2 | 1160 | 0 | 0 | 10.6 | 8 | 12 |
| 3 | 1160 | 2000 | 0 | 10.6 | 11 | 17 |
| 4 | 1160 | 2000 | 0 | 2.6 | 21 | 37 |
| 5 | 1160 | 0 | 2000 | 10.6 | 10 | 16 |
| 6 | 1160 | 2000 | 2.6 | 21 | 37 | |

The above examples illustrate the beneficial soil-resistant results obtained in accordance with the present invention. The date indicates (Example 4 vs 3 or 6 vs 5) that the soil resistance is maximized by using an inorganic acid (e.g. phosphoric acid or sulfuric acid) to provide a low dye bath pH (e.g. pH of 2.6). However, while the use of inorganic acids (mineral acids), e.g. phosphoric acid or sulfuric acid, to lower the dye bath pH has resulted in increasing the soil resistance of the carpet samples (e.g. Examples 4 and 6), the use of organic acids (e.g. 1.0% acetic acid or formic acid o.w.g.) to lower the dye bath pH has been found to reduce the soil resistance of the resulting carpet samples so treated to that of Example 1 (control).

EXAMPLE 7

In this example, blank dyed carpet soiling samples were prepared and tested by the procedure described in Example 1 except that the dye bath contained 1% phosphoric acid o.w.g. (pH 2.6) and varying amounts of F-I ranging from 0.2 to 0.5% o.w.g. In each instance the carpet samples soiled at about the same rate as when F-I was omitted entirely from the dye bath. A comparison of the result of Examples 1 and 4 with those of this example clearly point out the unexpected effect that zirconium has on the fluorochemical's ability to adhere to the yarn through the dyeing operation.

EXAMPLE 8

In this example blank dyed carpet soiling samples (8A, 8B and 8C) were prepared and tested as described in Example 7 except that the finish contained sufficient zirconium acetate to coat the yarn with 775 ppm of zirconium oxide measured as $ZrO_2$ and the dye bath contained sufficient F-I to coat the yarn with 2000 ppm thereof. The pH of the dye bath was 2.8 for 8A, 4.8 for 8B and 5.7 for 8C. For purposes of comparison the piling of a blank dyed carpet samples (8D) prepared as described in Example 1 was sprayed with F-I to provide 0.5% F-I thereon. 8A, 8B and 8C each had higher $t_{80}$ and $t_{85}$ values than 8D (i.e. soiled slower) with 8A having the highest t values followed by 8B and 8C, respectively.

Surprisingly, a blank dyed carpet sample (8E) prepared as described in Example 2 (i.e. from yarn coated with 1160 ppm zirconium oxide) and sprayed with F-I to provide 0.2% F-I thereon had substantially the same soiling characteristics ($t_{80}$ and $t_{85}$ values) as sample (8D). This demonstrates that the invention may be used to reduce the amount of fluorochemical used without any loss of soil-resistance imparted to the carpet. This is important since the cost of the fluorochemical is large in comparison to the cost of the retaining agent.

EXAMPLE 9

This example illustrates the importance of using a mineral acid to lower dye bath pH.

Using the general procedure described in the above examples, carpet soiling samples were made and tested using various acids and mixtures thereof to determine the effect thereof on soiling rate. When either acetic acid or formic acid is used to lower dye bath pH of yarns treated as described in Example 3, carpet samples made therefrom soil almost as rapidly as the carpet samples prepared as described in Example 1 (control). Surprisingly, however, the addition of 0.1% o.w.g. of phosphoric acid to a formic acid-containing dye bath (1.0%, pH 3.0), provides yarn having excellent soil-resistance comparable to that of yarn prepared as described in Example 4. The use of sulfuric acid to lower dye bath pH was found to produce results similar to those obtained when phosphoric acid was used.

EXAMPLE 10

This example illustrates the desirability of imparting soil-resistance to the yarn from which the carpet piling is made rather than to the surface of the finished carpet.

In this example carpet soil sample (10A), prepared, soiled and cleaned as described in Example 8, sample 8D, was compared to carpet soiling sample (10B), prepared, soiled and cleaned as described in Example 4. Each carpet sample had a pile height of $\frac{3}{4}$ inch (1.9 cm), 40 ounces of greige piling per square yard (1.357 $Kg/m^2$) of carpet and a gauge of $\frac{1}{8}$ inch (3.18 mm). When carpet samples 10A and 10B were viewed from the top (i.e. perpendicular to the pile facing), the samples appeared to possess about the same soil-resistant properties, carpet sample 10B perhaps appearing to be slightly less soiled. However, when the samples were viewed from the side (i.e. perpendicular to the tufts), the lower portion of the tufts of sample 10A (i.e. that portion of the tufts that had not been exposed to the F-I topical treatment) was badly soiled, whereas the lower portion of the tufts of sample 10B was not (the lower and top portions were both soil-resistant to the same extent). The entire length of the tufts of Sample 10B were uniformly soil-resistant, whereas only the top portion of the tufts of Sample 10A were soil-resistant.

EXAMPLE 11

This example illustrates the beneficial effect of having both a retaining agent and fluorochemical in the aqueous finish applied to carpet yarn.

In this example carpet soiling samples were prepared and tested to determine their $t_{80}$ as described in Example 1. In this instance the pH of the dye bath was adjusted to 2.8 by addition of $H_3PO_4$ thereto. A spin finish was applied to each yarn used in making the carpet samples. The amount of zirconium oxide measured as $ZrO_2$ and the amount of fluorocarbon applied to the yarn from the finish is given in the following table along with the $t_{80}$ value of each yarn.

TABLE II

| Sample | ppm $ZrO_2$ | ppm F-I | $t_{80}$ |
|---|---|---|---|
| 11A | 1000 | 2000 | 38 |
| 11B | 1000 | 3000 | 42 |
| 11C | 0 | 2000 | less than 5 |
| 11D | 1000 | 0 | 27 |
| 11E | 0 | 0 | less than 5 |

It will be noted that when zirconium acetate is omitted from the finish (11C), the soiling rate of the carpet is comparable to when neither zirconium acetate or fluorochemical are present in the finish (11E). This indicates that without the presence of a retaining agent the fluorocarbon when applied from a finish has little or no effect on soiling rate.

In the foregoing examples the yarn was coated with the retaining agent by applying a retaining agent precursor to the yarn from a spin finish. However, the retaining agent or its precursor and soil retardant may be applied to yarn at any time during or after preparation of the yarn or during or after construction of fabrics made from yarn (e.g. carpets, apparel, etc.), for example, the retaining agent or its precursor and soil retardant may be applied to the yarn from a finish other than a spin finish (e.g. from a finish used in producing staple yarn or from a dye bath or from a spray, for example, from an overspray applied to the finished carpet. According to one embodiment of the invention the retaining agent or its precursor and soil retardant are applied to the carpet yarn prior to tufting and then if the tufts are subsequently sheared as in the case of a cut-pile saxony construction, an over-spray containing both a retaining agent or a precursor thereof and soil retardant (the same as or different from those applied previously to the yarn) is applied to the sheared tuft ends.

It is contemplated that retaining agents, retaining agent precursors and soil retardants other than those specifically illustrated in the examples may be used in carrying out the invention. Those illustrated in the example are commercially available and, therefore, are presently preferred. However, it will be apparent to those skilled in the art that the invention encompasses any yarn coated with a coating comprising a fluorochemical (or other soil retardant) and retaining agent which coating provides yarn having a slower soiling rate than when the retaining agent is omitted from the coating. Moreover, while the invention has been illustrated with reference to carpets where soiling is a particular problem, the invention is also useful for apparel applications or other textile applications.

What is claimed is:

1. A yarn having a coating thereon comprising (i) an effective amount of a soil retardant selected from fluorochemicals containing a perfluoroalkyl radical and (ii) a metal oxide selected from the group consisting of zirconium oxide, tin oxide and titanium oxide, said coating being characterized in that said metal oxide being present in an amount sufficient to enhance the retention of the fluorochemical soil retardant on said yarn.

2. The yarn of claim 1 wherein the metal oxide is selected from the oxides of tin and zirconium.

3. The yarn of claim 2 wherein the metal oxide is a zirconium oxide.

4. The yarn of claim 3 wherein the metal oxide is a tin oxide.

5. The yarn of claim 3 wherein said fluorochemical is a bis-urethane prepared by the reaction of N-ethylperfluorooctanesulfonamidoethanol and tolylene diisocyanate.

* * * * *